US010974254B1

(12) United States Patent
Farrington et al.

(10) Patent No.: US 10,974,254 B1
(45) Date of Patent: Apr. 13, 2021

(54) HOPPER FOR SHREDDING FIBROUS MATERIAL

(71) Applicants: David Gerald Farrington, Murfreesboro, TN (US); Roger Boyd Moore, Lebanon, TN (US); Paul Wesley Rigsby, Nashville, TN (US)

(72) Inventors: David Gerald Farrington, Murfreesboro, TN (US); Roger Boyd Moore, Lebanon, TN (US); Paul Wesley Rigsby, Nashville, TN (US)

( * ) Notice: Subject to any disclaimer, the term of this patent is extended or adjusted under 35 U.S.C. 154(b) by 303 days.

(21) Appl. No.: 16/283,147

(22) Filed: Feb. 22, 2019

Related U.S. Application Data

(60) Provisional application No. 62/652,570, filed on Apr. 4, 2018, provisional application No. 62/777,085, filed on Dec. 8, 2018.

(51) Int. Cl.

| | |
|---|---|
| ***B02C 21/02*** | (2006.01) |
| ***B05B 7/14*** | (2006.01) |
| ***B02C 19/00*** | (2006.01) |
| ***B02C 4/02*** | (2006.01) |
| ***E04F 21/12*** | (2006.01) |
| ***B02C 18/22*** | (2006.01) |
| ***B02C 19/22*** | (2006.01) |

(52) U.S. Cl.
CPC ..... *B02C 21/02* (2013.01); *B02C 4/02* (2013.01); *B02C 18/2225* (2013.01); *B02C 18/2258* (2013.01); *B02C 18/2291* (2013.01); *B02C 19/0056* (2013.01); *B02C 19/22* (2013.01); *B05B 7/145* (2013.01); *E04F 21/12* (2013.01); *B02C 2201/00* (2013.01); *E04F 2290/045* (2013.01)

(58) Field of Classification Search
CPC . B02C 21/02; B02C 18/2291; B02C 18/2258; B02C 18/2225; B02C 18/22; B02C 19/22; B02C 19/0056
See application file for complete search history.

(56) References Cited

U.S. PATENT DOCUMENTS

| | | | | | |
|---|---|---|---|---|---|
| 3,061,206 | A | * | 10/1962 | Matter | B02C 21/02 241/60 |
| 4,848,605 | A | | 7/1989 | Wise | |
| 5,031,776 | A | | 7/1991 | Morgan, IV | |
| 5,156,499 | A | | 10/1992 | Miklich | |
| 5,340,035 | A | * | 8/1994 | Ford | B02C 13/02 241/55 |
| 5,511,730 | A | * | 4/1996 | Miller | B02C 18/12 241/101.4 |
| 5,647,696 | A | * | 7/1997 | Sperber | D01G 23/02 198/575 |
| 5,829,649 | A | * | 11/1998 | Horton | B02C 13/10 222/636 |
| 5,860,606 | A | * | 1/1999 | Tiedeman | A01G 3/002 241/101.78 |

(Continued)

*Primary Examiner* — Faye Francis
(74) *Attorney, Agent, or Firm* — Shane Cortesi

(57) ABSTRACT

Systems for shredding fibrous material are described. In some embodiments, the system includes a cart that includes a hopper that includes an auger motor for shredding fibrous material and a blower motor configured to blow the shredded fibrous material onto structures for fireproofing. The cart may include a handle, one or more wheels, and/or forklift apertures to aid in transport.

15 Claims, 9 Drawing Sheets

(56) References Cited

U.S. PATENT DOCUMENTS

| | | | | |
|---|---|---|---|---|
| 5,947,646 | A * | 9/1999 | Lytle | B05B 7/1409 406/109 |
| 6,070,814 | A * | 6/2000 | Deitesfeld | A01C 7/06 239/654 |
| 6,112,955 | A | 9/2000 | Lang | |
| 7,284,715 | B2 * | 10/2007 | Dziesinski | B02C 18/0007 241/100 |
| 7,520,459 | B2 * | 4/2009 | O'Leary | B65B 69/0008 100/215 |
| 7,731,115 | B2 * | 6/2010 | Johnson | E04F 21/085 241/101.8 |
| 7,845,584 | B2 * | 12/2010 | Bowman | B05B 7/1431 241/60 |
| 7,971,813 | B2 * | 7/2011 | O'Leary | E04F 21/085 241/60 |
| 9,457,355 | B2 * | 10/2016 | Conrad | B02C 18/2225 |
| 10,604,947 | B2 * | 3/2020 | Cook | E04F 21/085 |
| 2006/0231651 | A1 * | 10/2006 | Evans | B02C 18/2216 241/60 |
| 2013/0068866 | A1 * | 3/2013 | Conrad | B02C 21/02 241/220 |
| 2018/0112419 | A1 * | 4/2018 | Zabransky | E04F 21/085 |
| 2019/0127993 | A1 * | 5/2019 | Evans | B02C 21/02 |

* cited by examiner

HOPPER FOR SHREDDING FIBROUS MATERIAL

RELATED APPLICATIONS

This application claims priority under 35 USC 119 to U.S. Patent Application No. 62/652,570, filed Apr. 4, 2018 and U.S. Patent Application No. 62/777,085, filed Dec. 8, 2018, the contents of each of which are incorporated by reference in their entirety.

BACKGROUND

Technical Field

The present invention relates to construction machinery, especially machines for shredding and spraying fibrous material such as fireproofing and insulation.

Background of the Invention

Machines for shredding and spraying fibrous material for fireproofing and insulation are known in the art.

For example, Contractor's Consulting Service (CCS) sells the BOSS hopper for shredding and spraying fireproofing fibrous material. Unfortunately, such machines are not very portable, continually break down, and have crude electronic controls. The existing CCS system has four main drawbacks. First, an electrical enclosure that is not safe because there are multiple openings in the enclosure which are exposed to the environment. This does not allow the enclosure to be NEMA Type 14/4 rated. This enclosure will allow moisture to accumulate into the enclosure and risk/cause an electrical shock hazard. Second, it uses a multi-tap step up/step down transformer to accommodate differences in the incoming power voltage. The system relies on the operator to understand what voltage the incoming power currently is and what the system requires for incoming voltage. If the incoming voltage is not correct, then the operator must manually rotate a multi-position dial switch to change which transformer taps are being used. Most operators do not understand what the required voltage limits of the machine are or simply forget to do this step. This frequently causes the transformer to be set to the incorrect incoming taps and therefore the output voltage of the transformer is too high for the system. When this condition occurs, the machine destroys the DC drive and causes both the AC and DC motors to be damaged due to the transformer voltage being too high. The incorrect setting can also cause a low voltage condition. This low voltage condition will cause excessive heating of the AC motor and will lead to premature failure of the motor. The CCS system does not use circuit breakers/fuses to protect the system's electrical components and wiring. The use of circuit breakers protects the wiring from an over current situation that can lead to overheating, fire hazards and the potential for electrical shock. The use of circuit breakers also allows for a technician to analyze the problem quickly and reset the circuit breaker to allow faster restart of the system. This is much quicker than using fuses which have to be replaced rather than simply being reset. Third, it does not use a proper incoming power disconnect to disconnect power from the enclosure before allowing access into the enclosure. The system should use a disconnect that has an external disconnect handle that is interlocked. This interlocking will not allow the enclosure door to open if the disconnect is turned on and the electrical components in the enclosure are energized with electrical voltage/current. This creates a shock hazard by allowing access to the electrical system while energized. The disconnect also is not sealed to the enclosure and allows water an access point to enter the electrical enclosure. Fourth, the CCS system does not allow for adjustment of the AC drive blower speed. The blower AC motor is fixed at a constant speed and cannot be adjusted. If the operator determines it to be blowing too fast or with too much volume for their application the only way they can adjust it is by opening an air ball valve to vent excess air to the atmosphere. This causes an extremely loud condition with air blowing out of the ball valve with no noise suppression and could cause debris to be blown into the air.

Thus, there is a need for improved systems for shredding and spraying fibrous materials.

BRIEF SUMMARY

The present disclosure provides a system that includes a hopper for shredding fibrous material, especially dry fibrous material.

As described in the Background, prior art systems have a number of disadvantages. Thus, the present disclosure provides a system that includes one or more of the following features: 1) caster wheels below the bottom of the hopper that may be lockable; 2) a u-shaped handle, which may be located on the side opposite the airlock DC motor and may be removable, and directly above at least some of the caster wheels, and is optionally held in place by pins; 3) generally rectangular (and preferably equally sized) apertures, which are located below the bottom of the hopper and located on both the front and back sides of the cart, that are configured to receive forks of a forklift; 4) an alarm (preferably audible) configured to alert users prior to the shredders starting to rotate, which may be in electronic communication with a remote start button/trigger located on the hose (the remote may start the motors, which in turn rotate the shredders after a pre-determined amount of time); 5) a silencer tube and blower behind the hopper front and loading area (and preferably behind the hopper rear) to reduce the OSHA noise exposure limit to the operator; 6) a pressure relief valve located in line with and at the exit of the silencer tube; 7) a filter that is preferably circular and located in a removable housing for easy access and replacement; 8) a blower with variable speed/variable frequency; 9) a slideable safety guard that includes a handle; 10) a lighted estop; 11) PLC control; 12) NEMA 4 waterproof electrical ensures; and/or 13) self-compensating input voltage control for the motor, also known in the art as variable frequency drive. Some of the features, including the caster wheels, the forklift apertures and u-shaped handle may be located on a cart attached to the hopper.

BRIEF DESCRIPTION OF THE DRAWINGS

in FIG. 1, the rotatable shelf is in the deployed configuration.

in FIG. 2, the U-shaped handle is exploded to show how the handle may be removed from the cart.

in FIG. 3, the rotatable shelf is in the storage/inbound position.

in FIG. 4A, some housings and portions of the hopper walls are removed to best show the internal components.

in FIG. 4B, the tray has been exploded to show how the tray may be removed from the cart.

DETAILED DESCRIPTION

Figure 1:
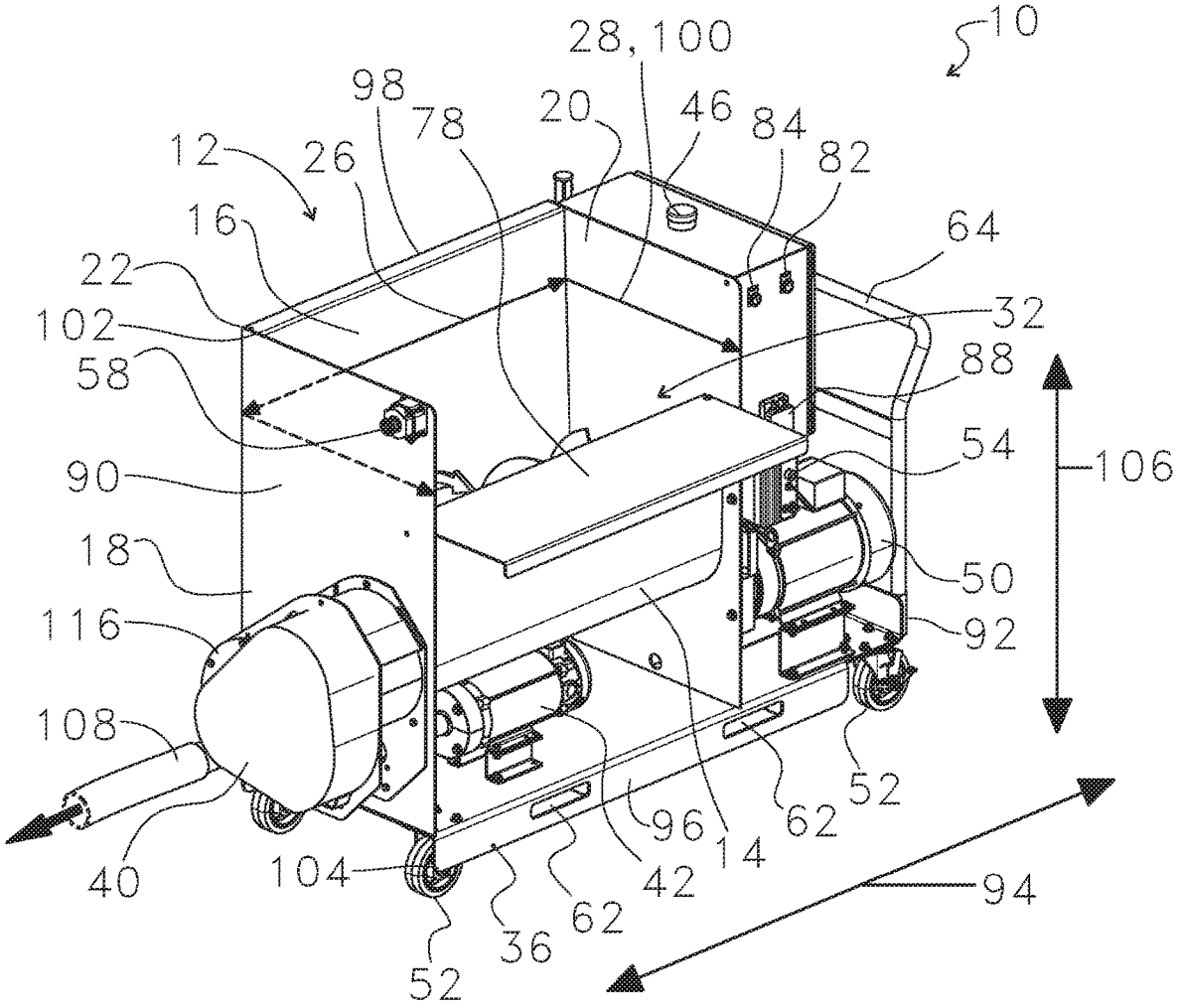
FIG. 1 illustrates a front perspective view of a hopper and cart of one embodiment of the present invention.
Figure 1A:
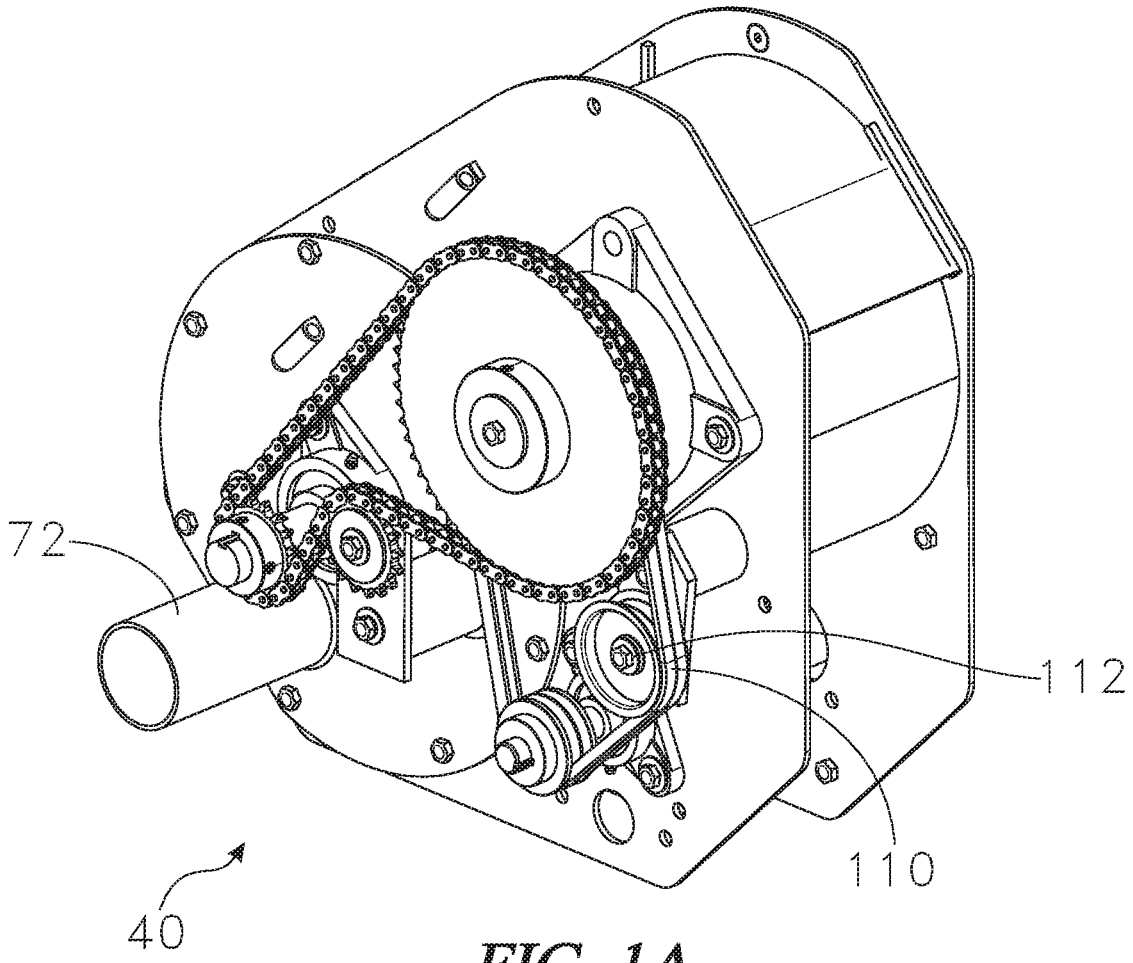
FIG. 1A illustrates a rear perspective view of the airlock assembly of the hopper of FIG. 1.

With reference to FIGS. 1-7, the present invention provides improved systems for shredding fibrous material generally designed by the numeral 10. In the drawings, not all reference numbers are included in each drawing for the sake of clarity. FIGS. 1-7 are CAD drawings, drawn to scale. However, it will be appreciated that other dimensions are possible.

Figure 2:
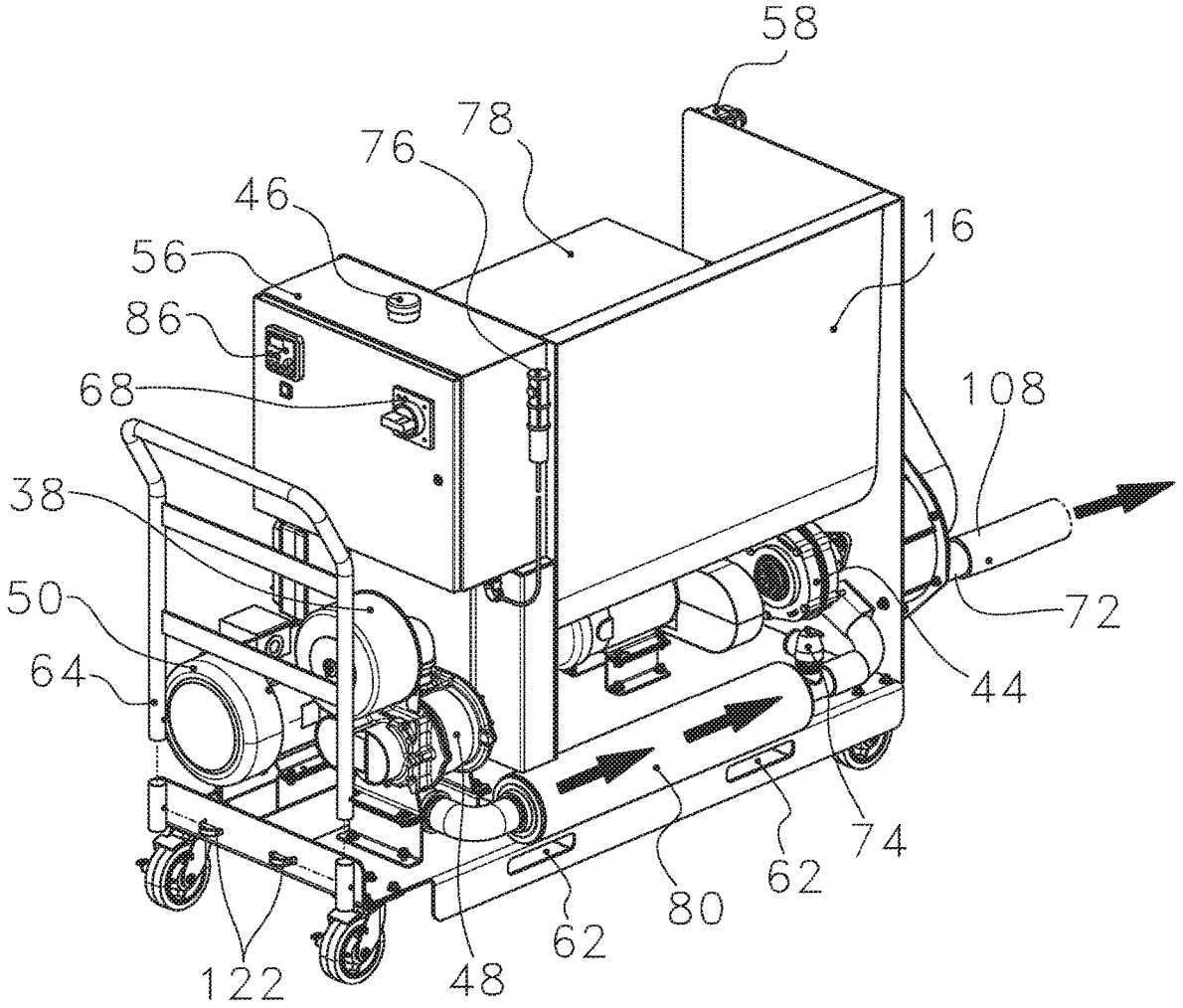
FIG. 2 illustrates a rear perspective view of the hopper and cart of FIG. 1.
Figure 3:
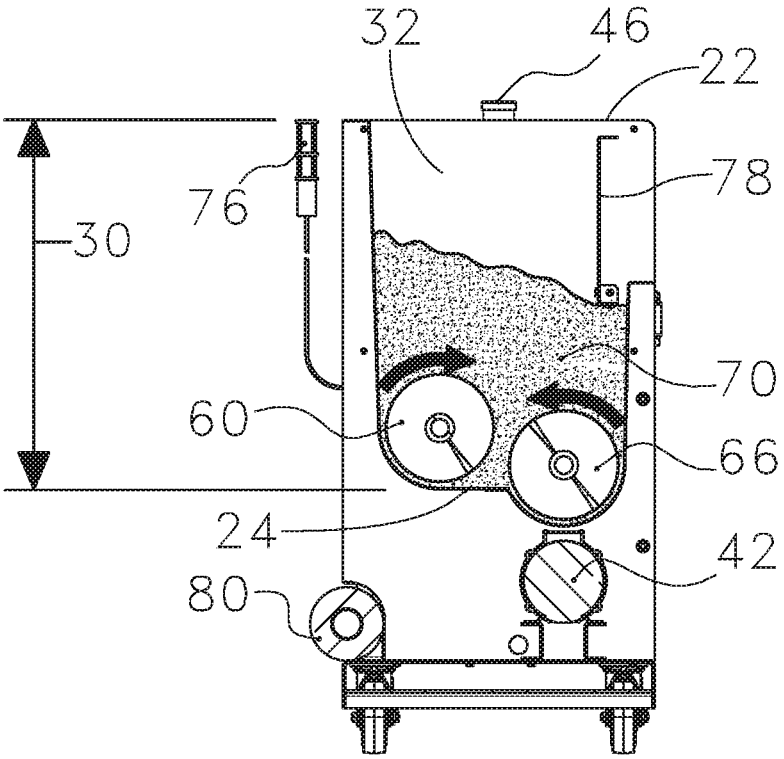
FIG. 3 illustrates a sectioned side elevation view of a hopper and cart of FIG. 1, with the arrows representing rotation of the augers, and with some components removed to better show the augers.

Referring further to FIGS. 1-7, the system 10 may include a hopper 12 having a left wall 18, a right wall 20, a bin length 26 extending from the left wall 18 to the right wall 20, a front wall 14, a rear wall 16, a bin width 28 extending from the front wall 14 to the rear wall 16 and generally perpendicular to the bin length 26, a bottom 24, a top 22, a height 30 extending from the bottom 24 to the top 22 and generally perpendicular to the bin length 26 and bin width 28. The front, rear, left and right walls 14, 16, 18, and 20 separate a hopper interior/chamber 32 from a hopper exterior. The hopper interior 32 further includes one or more shredders 60 and 66 designed to pick apart or shred the fibrous material 70, which is preferably dry. In some embodiments, the fibrous material 70 includes wool or another fiber mixed with cement for example. Portland cement-based fibrous mixtures are well-known in the art and includes the CAFCO line of fireproofing products sold by Isolatek International (Stanhope, N.J.) that is provided in bags. In a preferred embodiment, the shredders 60 and 66 are two augers in the form of screws that are connected to an airlock DC motor 42 that causes the shredders 60 and 66 to rotate in opposite directions, at different speeds. Preferably, the front wall 14 includes a rotatable shelf 78 so that the packs of fibrous material 70 may be loaded into the hopper interior 32 for shredding. The rotatable shelf 78 is a steady surface to rest bags of fibrous material 70 and assists the operator allowing them to empty the bags with ease. The shelf 78 can be rotated inboard from a deployed position, which is shown in FIG. 1, to an inbound position, which is shown in FIG. 3, to minimize width 28 when transporting to another location or through door ways. Preferably, at least when the rotatable shelf 78 is in the deployed position, the front wall 14 of the hopper 12 is lower than the rear wall 16.

Preferably, the hopper interior 32 includes a hopper interior outlet 34 located below the shredders 60 and 66 and the hopper interior outlet 34 is upstream from a hose 108 attached to system outlet 72 so that the material 70 shredded by the shredders 60 and 66 is transported out the hopper interior outlet 34 and ultimately to system outlet 72 and then to the hose 108 so that the material 70 may be sprayed onto building structures. Preferably, the system 10 further includes a blower 48 downstream from the hopper interior outlet 34 so that material 70 transported from the hopper interior outlet 34 is blown through the hose 108 and sprayed onto the building structures for fireproofing or insulation purposes.

The system 10 may also include an air filter 38 that filters air intake to the blower 48. The air filter 38 may consist of polyester/plastic element that removes particles from the air stream down to 5 microns, for example. The hopper 12 may be attached to, or integrally a component of, a cart 36 that further includes, among other things, a blower 48, an airlock assembly 40, an airlock DC motor 42 (also referred to herein as the auger motor), a blower AC motor 50, a silencer tube 80, and caster wheels 52. The cart 36 includes a cart left side 90, a cart right side 92, a cart length 94 extending from the cart left side 90 to the cart right side 92, a cart front 96, a cart rear 98, a cart width 100 extending from the cart front 96 to the cart rear 98, a cart top 102, a cart bottom 104, and a cart height 106 extending from the cart top 102 to the cart bottom 104. The caster wheels 52 that are attached to the bottom of the right side of the cart 36, may be swivel locking, and the right side of the cart 36 may further include a U-shaped handle 64. The handle 64 may be removable using pins 122, as best seen in the exploded view of FIG. 2, and may allow the user to steer the hopper 12 via the casters 52 when a forklift is not required for movement of short distances. The cart 36 may include rectangular forklift access apertures 62 located on both the front side of the cart 36 (as shown in FIG. 1) and the rear side of the cart 36 (as shown in FIG. 2) to allow safe lifting of the machinery to different locations via a forklift when long distances are required to transport to another location.

The feed auger screw 60 may be responsible for feeding material 70 to the main auger screw 66 in a cascading fashion. The main auger screw 66 accepts material 70 from the feed auger screw 60. Its function is to move material 70 out the hopper interior outlet 34 and toward the airlock assembly 40.

Figure 1B:
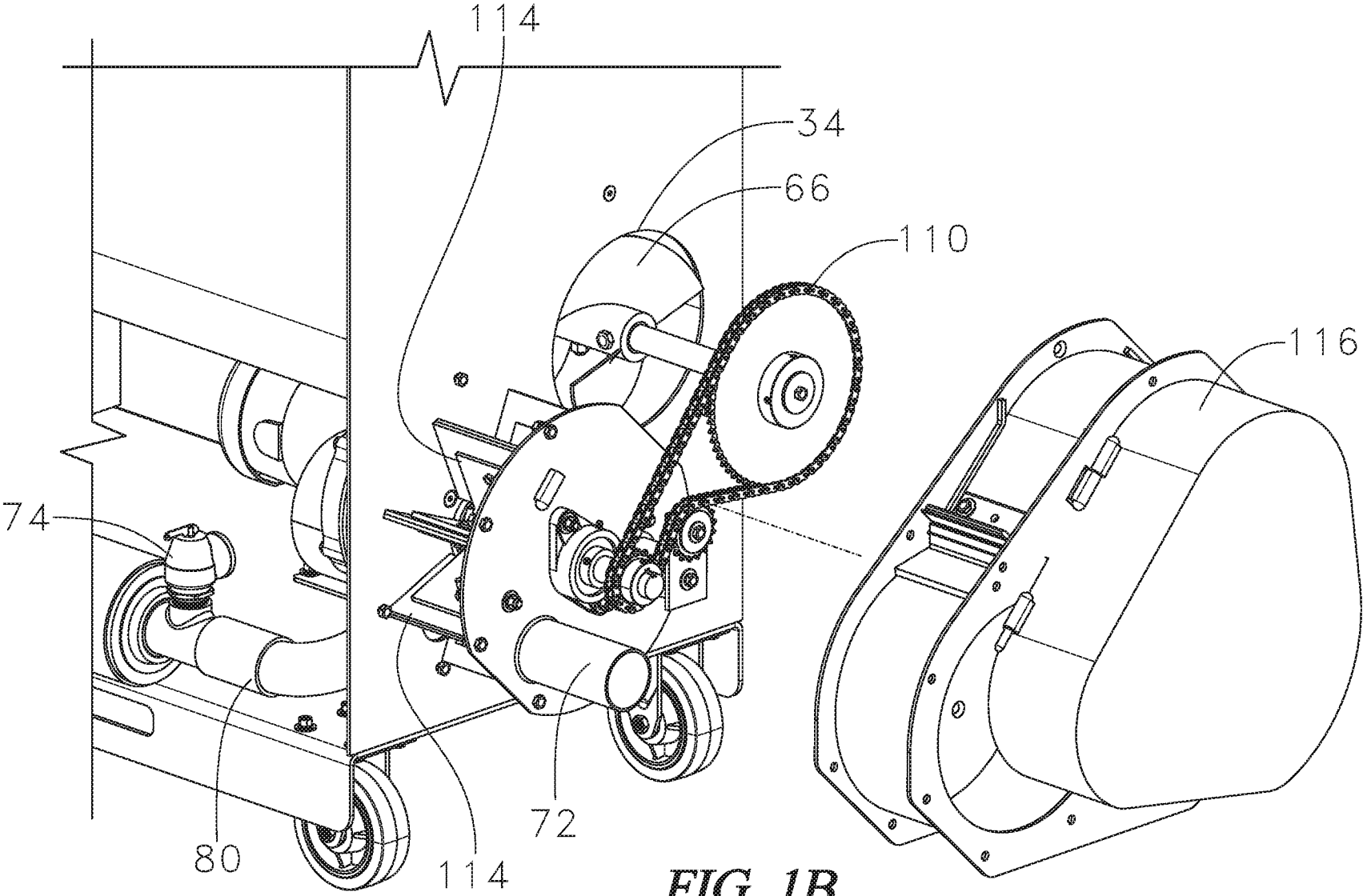
FIG. 1B illustrates an exploded front perspective view of a portion of the hopper and cart of FIG. 1, with a portion of the housings removed to better illustrate the internal components.

Material 70 churned by the main auger screw 66 may exit out the hopper interior outlet 34 and into the rotating disk 124. The rotating disk 124 has protruding carbide tips 126 that shred and shoot the material 70 into the pie wedged opening of the sealed round airlock chamber 40. The airlock chamber 40 may be comprised of an eight spoke paddle wheel 114 with rubber wipers that seal against the outer wall of the round airlock chamber 40. As the paddle wheel 114 rotates the material 70 is accepted in the pie wedged opening in the two o'clock position. The blower 48 creates an air stream through the silencer tube 80 at the seven o'clock position, as best seen in FIG. 1B. The paddle wheel 114 that is rotating in the counter clockwise direction presents the material 70 at the seven o'clock position and is blown through the system outlet 72. The airlock gearbox 44 reduces the revolutions per minute of the eight spoke paddle wheel 114 in the airlock assembly 40. The system outlet 72 is attached to a hose 108 so that the shredded material 70 may ultimately be sprayed via a sprayer (not shown) onto the building for fireproofing or other purposes. The silencer tube 80 may be a combination silencer that has a series of expansion chambers and interconnecting tubes that have acoustically-packed, sound absorbing material. The ends of the silencer tube 80, i.e., the inlet and outlet of the silencer tube 80, in particular may have the packed material to produce a greater reduction in sound decibels.

A pressure relief valve 74 may actuate when the pressure of a packed hose of the sprayer operator reaches more than 5 PSI. Examples of pressure relief valves include the Apollo (Matthews, N.C.) 13-213-B05 Safety Valve, 1-1/4 NPT inlet X 1-1/2 outlet, 5 PSI.

Optionally, the electrical box 56 consists of a back panel and electrical components that provide necessary power to run the AC and DC motors 42 and 50.

Optionally, the system 10 includes an emergency stop 58 configured to stop all power and movement of the machinery.

Optionally, the system 10 includes a main disconnect 68 which serves as a power switch to turn power on/off to the motors 42 and 50.

Optionally, the system 10 includes a watertight industrial remote start pendant 76 that allows the sprayer operator to control the function of the motors 42 and 50. For example, to start the feed auger screw 42 and main auger screw 48, the sprayer operator must press the start button 82 for five seconds that will alert, via an audible alarm 46, the material operator that the motors 42 and 50 are about to start and to stand clear. The start button 82 initiates the start of the motors 42 and 50 and the stop button 84 initiates the stop of the motors 42 and 50.

The system 10 may include a variable frequency AC drive, which is used to adjust the speed of the blower AC motor 50 which is displayed in Hertz (Hz).

The system 10 may include a 120V outlet, which is used in the event a water pump needs to be used to increase water pressure.

The airlock DC motor 42 is responsible for rotating the feed auger screw 60, main auger screw 66 and airlock assembly 40 through a series of belts and pulleys. The DC drive 54 controls the speed of the airlock DC motor 42.

Figure 4A:
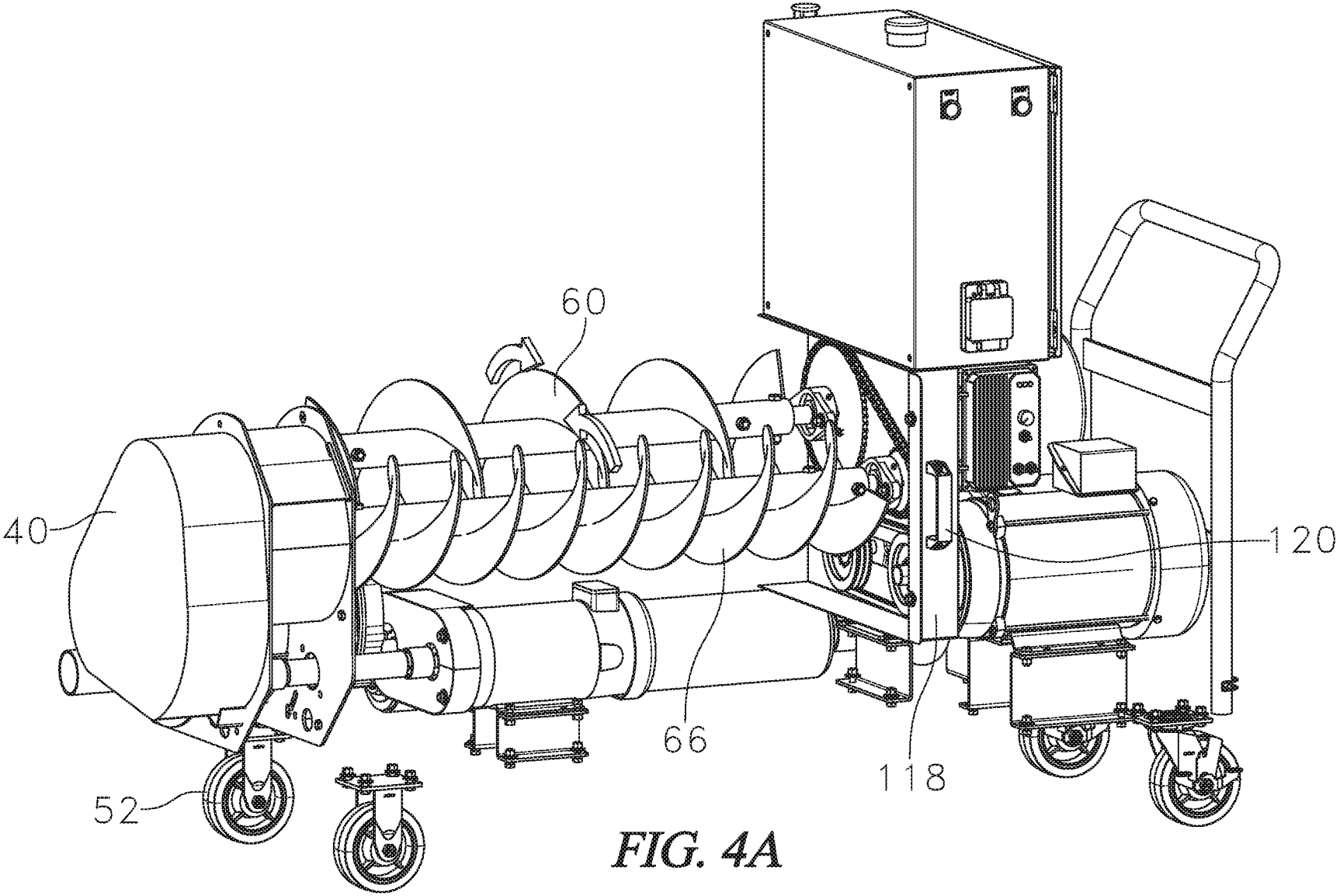
FIG. 4A illustrates a front perspective view of a hopper and cart of another embodiment of the present invention.
Figure 4B:
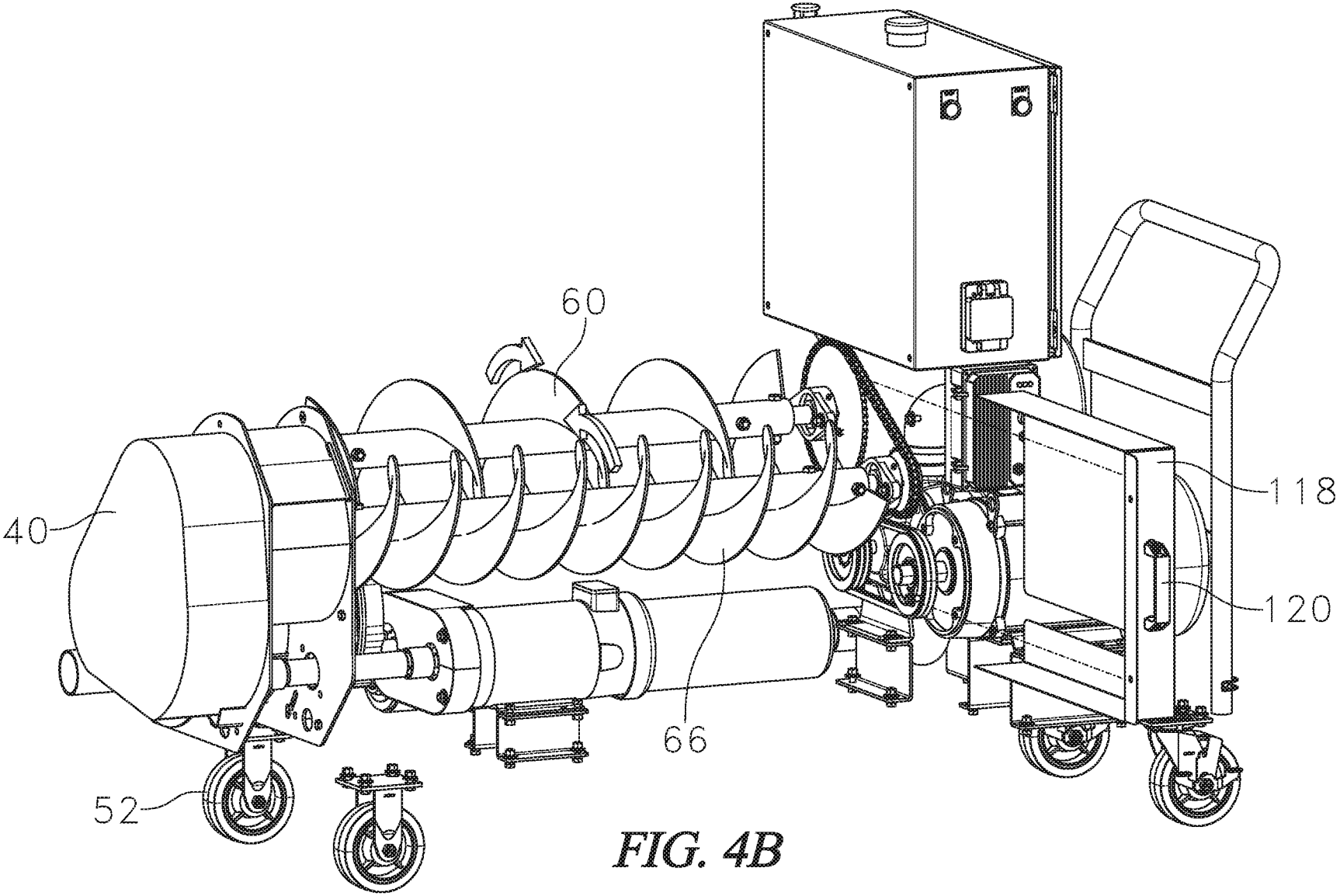
FIG. 4B illustrates a front perspective view of a hopper and cart of FIG. 4B.
Figure 5:
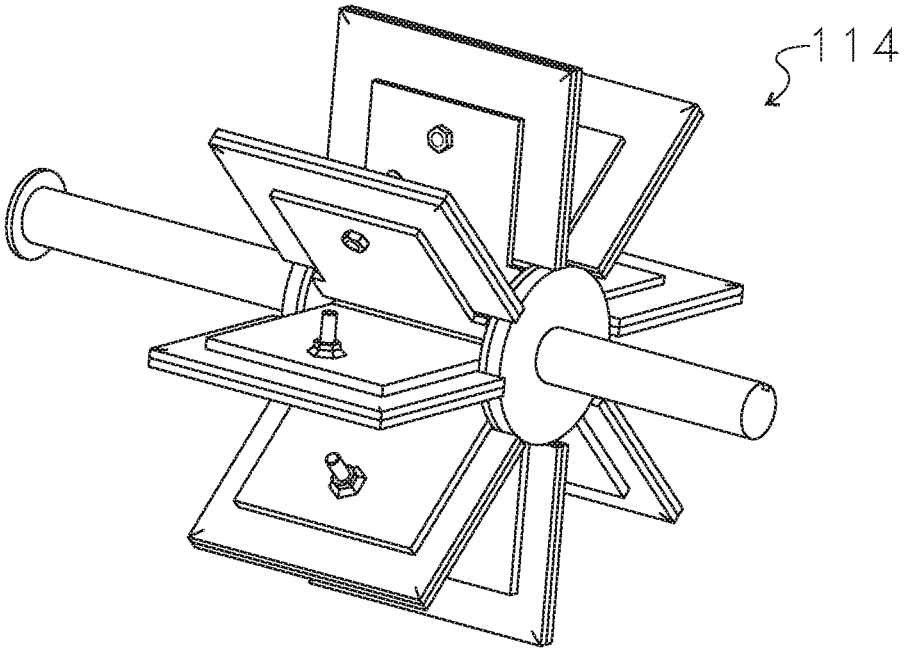
FIG. 5 illustrates a side perspective view of the paddle wheel of the hopper of FIG. 1.
Figure 6:
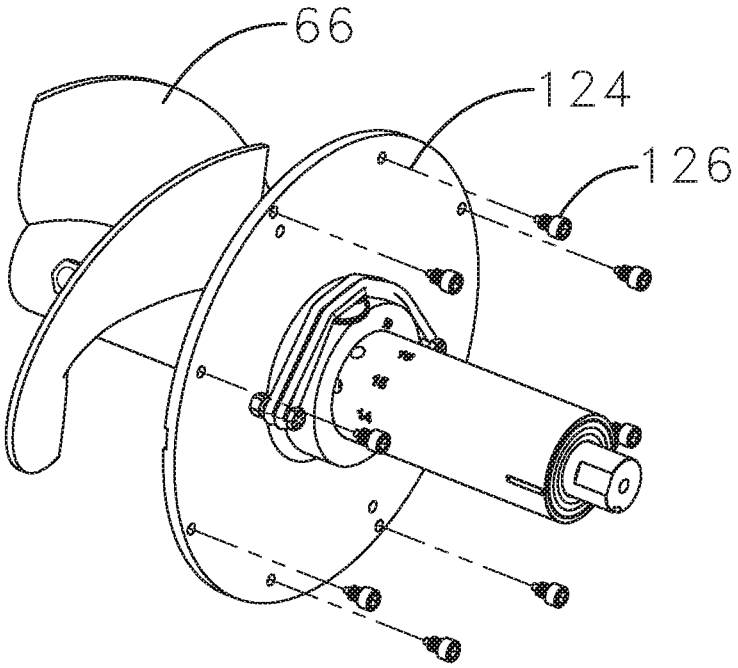
FIG. 6 illustrates a side perspective view of the main auger screw and rotatable disk of the hopper of FIG. 1.
Figure 7:
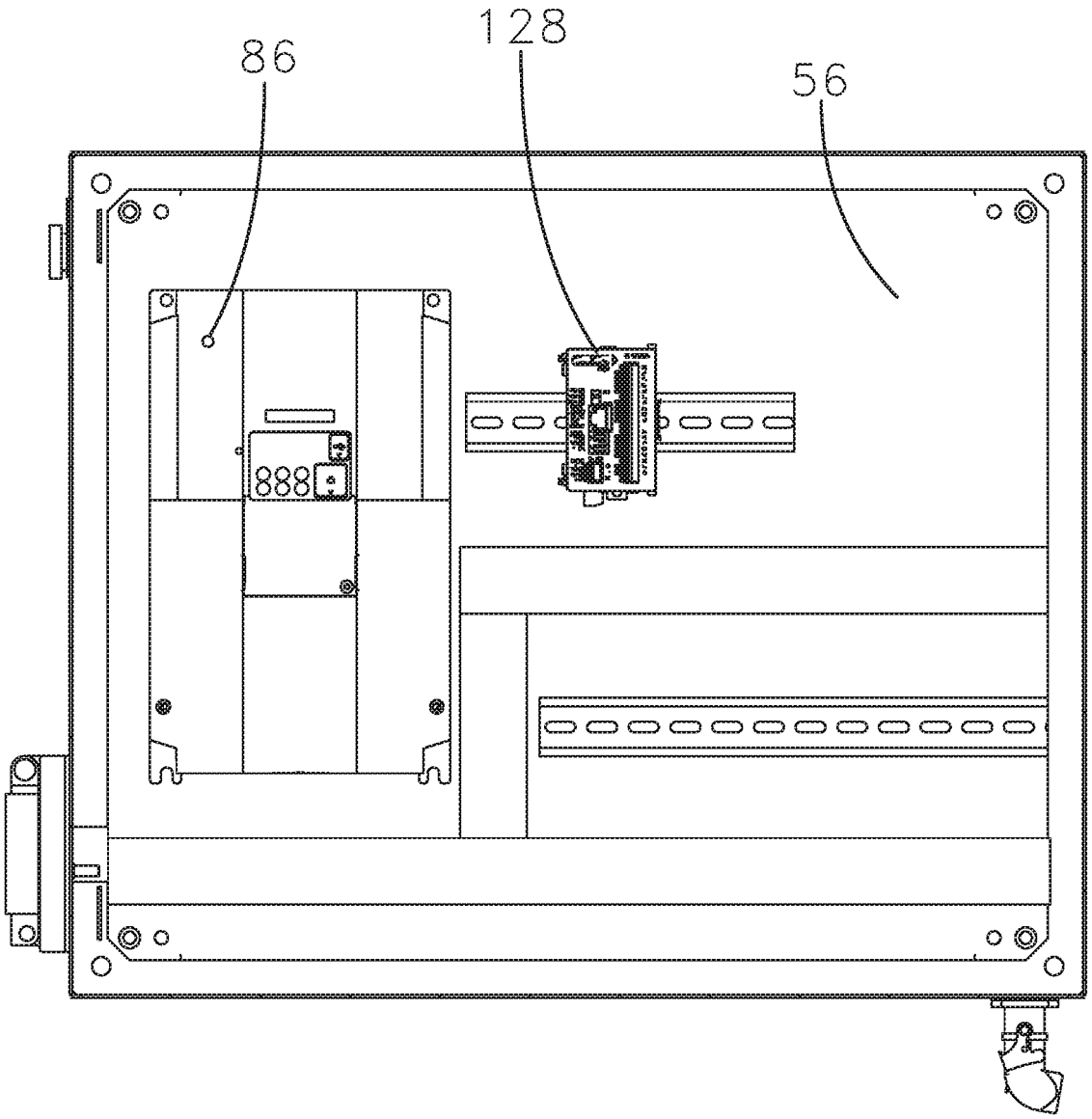
FIG. 7 illustrates a side elevation view of the interior of the electrical box of the hopper of FIG. 1.

The system 10 may further include a slideable safety guard in the form of a tray 118 that includes a handle 120, as best seen in FIGS. 4A and 4B.

The system 10 may also include a PLC 128 (Programmable Logic Controller), which is a programmable controller that is used to control the functions of the system 10. The PLC 128 is used to accept inputs from various switches/sensors and then makes decisions and control outputs based on the programmed logic. The system 10 may use the PLC 128 to accept inputs from the remote start pendant 76 and the DC drive start and stop switches 82 and 84, respectively. The outputs of the PLC 128 are used to turn on the audible alarm 46 for five seconds before starting the augers 60 and 66. The PLC 128 outputs are also used to start and stop the DC drive 54 which controls the augers 60 and 66. The PLC 128 allows for future flexibility. Input and outputs can be added.

The system 10 may also include VFD (Variable Frequency Drive) to allows fine tuning of blower 48 speed and auto-compensates for incoming voltage differences without the need to manually select input voltage range. This keeps from destroying motors 50 if operator does not select the proper input voltage setting. (200-240±10%). It also allows gradual ramp up and ramp down of blower motor 50 to minimize startup torque.

Part List

| | | |
|---|---|---|
| System | 10 Blower AC Motor | 50 |
| Hopper | 12 Casters | 52 |
| Hopper Front wall | 14 DC Drive | 54 |
| Hopper Rear wall | 16 Electrical Box | 56 |
| Hopper Left wall | 18 Emergency Stop | 58 |

-continued

Part List

| | | |
|---|---|---|
| Hopper Right wall | 20 Feed Auger Screw | 60 |
| Hopper Top | 22 Forklift Access | 62 |
| Hopper Bottom | 24 Handle | 64 |
| Hopper Bin Length | 26 Main Auger Screw | 66 |
| Hopper Bin Width | 28 Main Disconnect | 68 |
| Hopper Height | 30 Material | 70 |
| Hopper Interior | 32 System Outlet | 72 |
| Hopper Interior Outlet | 34 Pressure Relief Valve | 74 |
| Cart | 36 Remote Start Pendant | 76 |
| Air Filter | 38 Rotatable Shelf | 78 |
| Airlock Assembly | 40 Silencer tube | 80 |
| Airlock DC Motor | 42 Start Button | 82 |
| Airlock Gearbox | 44 Stop Button | 84 |
| Audible Alarm | 46 Variable Frequency AC Drive | 86 |
| Blower | 48 120 V Outlet | 88 |
| Hose | 108 Cart left side | 90 |
| Belt | 110 Cart right side | 92 |
| Pulley | 112 Cart length | 94 |
| Paddle Wheel | 114 Cart front | 96 |
| Housing | 116 Cart rear | 98 |
| Slideable Safety Guard | 118 Cart width | 100 |
| Handle of Slideable Safety Guard | 120 Cart top | 102 |
| Pins | 122 Cart bottom | 104 |
| Rotatable Disk | 124 Cart height | 106 |
| Carbide tips | 126 | |
| Programmable Logic Control | 128 | |

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed. Use of the singular embraces the plural.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A system for shredding fibrous material comprising:

a cart comprising a cart left side, a cart right side, a cart length extending from the cart left side to the cart right side, a cart front, a cart rear, a cart width extending from the cart front to the cart rear, a cart top, a cart bottom, and a cart height extending from the cart top to the cart bottom;

a handle extending upwardly from the cart bottom and located on the cart right side;

a plurality of lockable caster wheels extending downwardly from the cart bottom and located on the cart right side, the plurality of lockable caster wheels configured to allow the cart to be moved along the ground;

a pair of left wheels extending downwardly from the cart bottom and located on the cart left side, the pair of left wheels configured to allow the cart to be moved along the ground;

a pair of front forklift access apertures located on the cart front and a pair of rear forklift access apertures located on the cart rear and aligned with the front forklift access apertures, the front and rear forklift access apertures configured to allow forks of a forklift to extend across the cart;

a hopper located above the cart bottom and comprising a left wall, a right wall, a bin length extending from the left wall to the right wall and parallel to the cart length, a front wall, a rear wall, a bin width extending from the front wall to the rear wall and perpendicular to the bin length and parallel to the cart width, a bottom, a top, a height extending from the bottom to the top and perpendicular to the bin length and bin width and parallel to the cart height, the front, rear, left and right walls separating a hopper interior from a hopper exterior;

a pair of augers located in the hopper interior and configured to shred fibrous material;

an auger motor configured to rotate the augers in opposite directions and at different speeds;

a hopper interior outlet located below the pair of augers in the hopper interior; and a blower comprising a blower motor configured to blow shredded fibrous material received from the hopper interior outlet out a system outlet, the system outlet in communication with the hopper interior outlet and configured to attach to a hose, wherein the front wall of the hopper comprises a rotatable shelf, the rotatable shelf configured to rotate from a deployed configuration in which the rotatable shelf is oriented horizontally to an inbound configuration position in which the rotatable shelf rotates toward the hopper interior.

2. The system of claim 1 wherein the cart rear side further comprises a silencer tube in communication with the hopper interior outlet and the system outlet, the silencer tube configured to transport material received from the hopper interior outlet to the system outlet.

3. The system of claim 1 wherein the system further comprises a hose connected to the system outlet and a pressure relief valve located downstream from, and in communication with, the hopper interior outlet and upstream from, and in communication with, the system outlet, the pressure relief valve configured to allow air to escape from the system and alleviate pressure build up in the hose.

4. The system of claim 1 further comprising a variable frequency AC drive configured to adjust the speed of the blower motor.

5. The system of claim 1 wherein the handle is U-shaped and removable.

6. The system of claim 1 wherein each of the front and rear forklift apertures are the same size and have four sides.

7. The system of claim 1 wherein the system further includes a remote start button and an audible alarm, and further wherein actuating the remote start button is configured to actuate the audible alarm and then cause the auger motor to rotate the augers after actuating the audible alarm.

8. The system of claim 7 wherein the remote start button is water resistant.

9. The system of claim 1 wherein the system further comprises a filter housing and an air filter located in the filter housing, the air filter configured to filter particulates from air before air enters the blower.

10. The system of claim 1 wherein the caster wheels are located directly below the handle.

11. A method of spraying dry fibrous material for fireproofing comprising the steps of:

a) providing the system of claim 1, wherein the system further comprises a hose connected to the system outlet;

b) loading fibrous materials into the hopper interior;

c) using the auger motor to rotate the augers and shred the fibrous material; and d) using the blower motor to blow the shredded fibrous material out the hopper interior outlet, out the system outlet, and into the hose; and e) spraying the shredded fibrous material onto a building structure to enhance the fire safety of the building structure.

12. The method of claim 11 wherein the method further comprises, prior to step b), placing bags comprising the fibrous material on the rotatable shelf when the rotatable shelf is in the deployed configuration.

13. The method of claim 11 wherein the method further comprises transporting the cart along the ground using the caster wheels and the left side wheels.

14. The method of claim 1 wherein the method further comprises placing forks of a forklift through the forklift access apertures and moving the cart using the forklift.

15. The system of claim 1 wherein the front and rear forklift access apertures are configured to allow forks of a forklift to extend parallel to the cart width.

* * * * *